United States Patent [19]

Cote

[11] 4,027,774

[45] June 7, 1977

[54] RUBBISH CONTAINER

[76] Inventor: Leopold J. Cote, 17 Clifton St., Cambridge, Mass. 02138

[22] Filed: July 22, 1975

[21] Appl. No.: 591,187

[52] U.S. Cl. ..... 220/63 R; 220/1 T; 220/65; 248/99

[51] Int. Cl.² ..... B65D 25/16; B65B 67/12

[58] Field of Search ..... 220/63 L, 65, 1 T, 17; 248/95, 99–101

[56] References Cited

UNITED STATES PATENTS

| | | | |
|---|---|---|---|
| 2,159,192 | 5/1939 | Werdin | 220/65 |
| 3,128,904 | 4/1964 | Reilly | 220/65 |
| 3,784,049 | 1/1974 | Hawk | 220/65 X |
| 3,825,150 | 7/1974 | Taylor | 220/65 X |
| 3,836,037 | 9/1974 | Bass | 220/65 X |

*Primary Examiner*—Stephen Marcus
*Attorney, Agent, or Firm*—Joseph H. Killion

[57] ABSTRACT

A container, such as a rubbish container, is adapted to secure a flexible plastic liner in an open position conforming to the shape of the container's interior. The securing of the flexible plastic liner is accomplished by the cooperation of the rim of the container about the periphery of which the edge of the flexible plastic liner is tightened forming an ear in the holder's hand and a notched member into which the ear is inserted to hold the flexible plastic liner securely in the proper position in the container.

6 Claims, 2 Drawing Figures

RUBBISH CONTAINER

Figure 1:
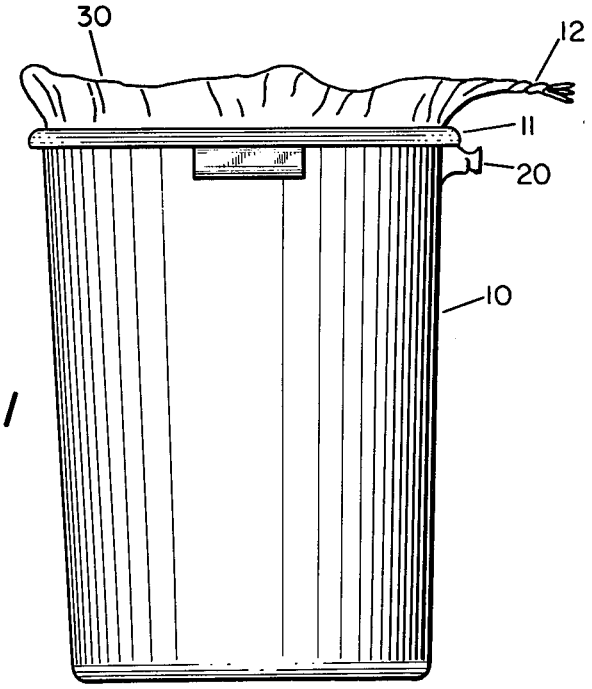
Figure 2:
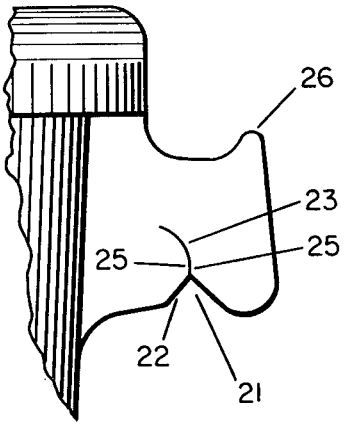

The present invention relates to the secure positioning of a flexible plastic liner in a container such as a rubbish container.

Men have used bucket-type containers since time immemorial as recepticles for rubbish. Flexible plastic liners have made it possible to collect the rubbish or other materials, within the flexible plastic liner, remove the flexible plastic liner from the container, tie it up, and handle it readily. One of the major disadvantages with flexible plastic liners is that the coefficient of friction of the polymeric materials (eg. polyethylene, polypropylene) generally utilized to make flexible plastic liners, is rather low. Add to this factor the trend towards more and more plastic containers and we have in some cases two low friction surfaces which we are attempting to secure in the proper relation one to the other. This problem is seen in everyday life when the flexible plastic liner slips to the bottom of the trash container, if not when initially positioned, then when some object is placed therein.

The primary object of the present invention is to provide means for securing the flexible plastic liner in the proper open position to the interior of the container. Another object is to provide means for adapting presently existing containers to securely retain flexible plastic liners.

A further object of the present invention is to make the means for securing the flexible plastic liner in the proper position in the container simple, efficient and economical.

Other aspect, objects, and the several advantages of this invention are apparent to one skilled in the art from a study of this disclosure, the drawings and the appended claims.

These and other objects are accomplished by the parts, constructions, arrangements, combinations and subcombinations comprising the present invention, the nature of which is set forth in the following description and illustrated in the accompanying drawings and which are particularly and distinctly pointed out and set forth in the appended claims forming a part thereof.

The nature of the present invention may be stated in general terms as comprising a container with a notched member. This notched member extends outward from the main body of the container. In one preferred embodiment, the notch is substantially vertical, having top, outer and lower boundaries. The flexible plastic liner, after being placed in the container and properly positioned, is tightened around the periphery or rim of the container by gathering and twisting the edge of the flexible plastic liner by hand. The ear formed by the twisting of the edge is turned over the top of the notched member then grasped by wedging the end of the ear in the entry portion of the notch and pushing it up the long portion of the notch and around the curve at the top. The ear is then held in place in the notched member by the flex tension of the lobes of the notched member, and the tension supported by the outwardly and upwardly extending top surface of the notched member.

In the drawings:

FIG. I is a frontal view of a typical container with an outwardly projecting notched member.

FIG. II is a cut-away of the notched member.

Referring now in particular to the accompanying drawings, an example of the improved container constituting the present invention is generally indicated in FIG. I at 10 and includes a rim 11 extending around the periphery of the container outwardly from the main body of the container 10. A notched member 20 extends outwardly from the container 10 and has a slotted section 21. This slotted section is more fully depicted in FIG. II wherein it is shown to have slot 21, a V-shaped entry portion 22, a passage 23 extending substantially vertically from the V-shaped entry portion 22 to its termination in the notched member 20. Lobes 25 extend along the passage 23. The edge of the flexible plastic liner 30 is drawn up and over the outwardly extending rim 11, and twisted to tighten it around the periphery. The ear 12 so formed is turned over a top surface 26 and inserted into the V-shaped entry portion 22 of the slotted section 21 substantially to the termination of passage 23. The ear is then held in place by the flex tension of notched member 20 at sidewalls 25 along passage 23, and the stress relieved by turning over the top surface 26.

While the preferred embodiment shows a substantially round container, it is fully contemplated that other shapes such as a square or rectangular could be utilized without departing from the spirit and scope of the invention. The preferred embodiment shows the notch as Y-shaped and substantially vertical. Other shapes could be utilized and work on the principles shown in this invention.

While in the preferred embodiment a "tab" type notched member is disclosed, other embodiments of a notched member such as suitably adapting a handle of the container are fully contemplated.

In the foregoing description, certain terms have been used for brevity, clearness and understanding but no unnecessary limitations are to be implied therefrom beyond the requirements of the prior art, because such words are used for descriptive purposes herein and are intended to be broadly construed.

Moreover, the embodiments of the improved construction illustrated and described herein are by way of example and the scope of the invention is not limited to the exact details of construction.

Having now described the invention, the construction, the operation and use of preferred embodiments thereof, and the advantageous new and useful results obtained thereby; the new and useful constructions, and reasonable mechanical equivalents thereof obvious to those skilled, are set forth in the appended claims:

I claim:

1. A container comprising:

a. a trash can having a rim about the mouth thereof;

b. a flexible plastic liner disposed within said trash can to receive rubbish therein, having an edge thereof tightened about the rim and twisted to form an ear c. a notched member cooperating with the rim of said trash can arranged to receive the ear of the flexible plastic liner and hold the flexible plastic liner detachably and securely in an open configuration.

2. A container as in claim 1 wherein said flexible plastic liner is composed of a plastic selected from the group consisting of polyethylene, polypropylene and the copolymers thereof.

3. A container as in claim 1 wherein said notched member comprises:

a. A tab extending radially and vertically outside of and below said rim; said tab having a top boundary, an outer boundary and a lower boundary; said top boundary outwardly and upwardly extending to support and contain said ear of the flexible plastic liner; said lower boundary being formed with an upwardly extending notch adapted to grasp by wedging the end of said ear.

4. A container as in claim 3 wherein said notch is generally Y-shaped having an open inverted V-shaped entry portion and a slot extending upward from the vertes of said V-shaped entry part.

5. A container as in claim 4 wherein said Y-shaped slot curves upwardly, and inwardly.

6. A method for securing a flexible plastic liner in a trash can which method comprises:

a. positioning the flexible plastic liner in a trash can;

b. tightening the edge of the flexible plastic liner about the rim of the trash can, forming an ear of said flexible plastic liner;

c. inserting said ear into a notched member which cooperates with the rim of said trash can to hold the flexible plastic liner securely and detachably in an open configuration.

* * * * *